US012022940B2

(12) United States Patent
Weidmann et al.

(10) Patent No.: US 12,022,940 B2
(45) Date of Patent: Jul. 2, 2024

(54) HEIGHT-ADJUSTABLE OFFICE FURNITURE

(71) Applicant: Actiforce International B.V., Bunschoten-Spakenburg (NL)

(72) Inventors: Thomas Weidmann, Penang (MY); Kam Shiun Loh, Penang (MY)

(73) Assignee: Actiforce International B.V., Bunschoten- Spakenburg (NL)

( * ) Notice: Subject to any disclaimer, the term of this patent is extended or adjusted under 35 U.S.C. 154(b) by 35 days.

(21) Appl. No.: 17/972,619

(22) Filed: Oct. 25, 2022

(65) Prior Publication Data

US 2023/0131791 A1 Apr. 27, 2023

(30) Foreign Application Priority Data

Oct. 26, 2021 (EP) ..... 21204781

(51) Int. Cl.
*A47B 21/02* (2006.01)
*A47B 9/04* (2006.01)

(52) U.S. Cl.
CPC ..... *A47B 21/02* (2013.01); *A47B 9/04* (2013.01); *A47B 2200/0056* (2013.01); *A47B 2200/0061* (2013.01)

(58) Field of Classification Search
CPC ... A47B 21/02; A47B 9/04; A47B 2200/0056; A47B 2200/0061; A47B 2200/0062
USPC ..... 108/147, 144.11
See application file for complete search history.

(56) References Cited

U.S. PATENT DOCUMENTS 2,819,134 A * 1/1958 Klevholm ..... A47B 9/04 108/147
4,635,565 A * 1/1987 Novak ..... A47B 9/08 108/147
6,352,037 B1 * 3/2002 Doyle ..... A47B 9/00 108/50.02
6,820,908 B1 * 11/2004 Tousi ..... B62D 21/11 248/609
8,056,880 B2 * 11/2011 Tsuchida ..... G11B 33/124 248/580
10,094,456 B2 * 10/2018 Hu ..... F16H 25/20
(Continued)

FOREIGN PATENT DOCUMENTS

CN 108542108 A 9/2018
CN 209202293 U 8/2019
(Continued)

OTHER PUBLICATIONS

Extended European Search Report of Application No. EP 21 20 4781 Dated Aug. 4, 2022.

*Primary Examiner* — Jose V Chen
(74) *Attorney, Agent, or Firm* — Collard & Roe, P.C.

(57) ABSTRACT

A height-adjustable office furniture comprising a table top, at least one height adjustable leg unit and a drive unit to drive adjustment of the height of the leg, a drive control system configured to control and power the drive unit and an anti-collision system connected to the drive control system and configured to detect when movement of the table top along the vertical direction Z is blocked. A resilient element is provided in the connection between the drive unit and the table top, the resilient element defining a suspension travel extending along a vertical direction Z to reduce vibrations.

14 Claims, 4 Drawing Sheets

(56) References Cited

U.S. PATENT DOCUMENTS

| | | | | |
|---|---|---|---|---|
| 10,568,418 | B2 * | 2/2020 | Applegate | A47B 3/08 |
| 2011/0168064 | A1 * | 7/2011 | Jahnsen | A47B 13/021 108/147 |
| 2013/0293173 | A1 * | 11/2013 | Strothmann | A47B 9/20 318/466 |
| 2014/0096706 | A1 * | 4/2014 | Labrosse | G05B 19/048 108/21 |
| 2016/0051042 | A1 * | 2/2016 | Koch | H02K 11/40 318/446 |
| 2016/0170402 | A1 * | 6/2016 | Lindström | A47B 9/00 700/275 |
| 2018/0172062 | A1 * | 6/2018 | Hu | F16H 25/2056 |
| 2018/0235360 | A1 | 8/2018 | Li | |
| 2018/0338608 | A1 * | 11/2018 | Keller | A47B 9/12 |
| 2019/0098994 | A1 * | 4/2019 | Smed | G05B 19/416 |
| 2019/0223586 | A1 * | 7/2019 | Hansen | G06V 40/12 |
| 2019/0298055 | A1 * | 10/2019 | Yamamoto | A47B 9/00 |
| 2019/0328129 | A1 * | 10/2019 | Namala | A47B 9/20 |
| 2019/0357668 | A1 * | 11/2019 | Knudtson | A47B 9/04 |
| 2019/0369578 | A1 * | 12/2019 | Xiang | A47B 21/02 |
| 2020/0214439 | A1 * | 7/2020 | Bennett | A47B 9/20 |
| 2020/0329860 | A1 * | 10/2020 | Xiang | A47B 9/00 |
| 2021/0100355 | A1 * | 4/2021 | Jørgensen | A47B 9/20 |
| 2021/0227970 | A1 * | 7/2021 | Randløv | A47B 9/20 |
| 2021/0386193 | A1 * | 12/2021 | Bucquet | A47C 31/126 |
| 2022/0031062 | A1 * | 2/2022 | Albert | A47B 9/20 |
| 2022/0079333 | A1 * | 3/2022 | Albert | A47B 9/00 |
| 2022/0243793 | A1 * | 8/2022 | Hu | F16H 25/2454 |
| 2022/0378194 | A1 * | 12/2022 | Lin | A47B 21/06 |

FOREIGN PATENT DOCUMENTS

| | | | |
|---|---|---|---|
| CN | 213820297 | U | 7/2021 |
| DE | 102016212642 | B3 | 1/2018 |
| KR | 101597741 | B1 | 2/2016 |

* cited by examiner

HEIGHT-ADJUSTABLE OFFICE FURNITURE

TECHNICAL FIELD

The invention relates to height-adjustable office furniture and a frame for height adjustable office furniture.

BACKGROUND ART

In offices it is frequently desired to provide a working or sitting surface with an adjustable height. To that end, electronically adjustable office furniture is provided, such as sit-stand desks, drawing tables, or office chairs.

For example, patent document US 2018/0235360 A1 shows a height adjustable workstation. The workstation has a top workspace area and a movable base consisting of two or four legs, wherein each movable leg includes a linear actuator mechanism and a power box. The power box controls the movement of the linear actuator mechanism which further controls the movement of the legs such that the work station can be raised and lowered on command.

A problem experienced with the known adjustable office furniture is their noise production and the occurrence of vibrations of the top workspace area during height adjustment. It would be desirable to provide electronically height-adjustable office furniture, which improves on existing furniture, reduces noise production and/or reduces vibrations.

SUMMARY OF INVENTION

Therefore, according to a first aspect of the invention, there is provided height-adjustable office furniture comprising a table top having a top surface and a bottom surface opposite to the top surface; at least one height adjustable leg unit connected to the table top, wherein the at least one leg unit is provided with a drive unit to drive adjustment of the height of the leg, wherein a resilient element is provided in the connection between the drive unit and the table top, the resilient element defining a suspension travel of the table top extending along a vertical direction Z; the office furniture further comprising a drive control system configured to control and power the drive unit; and an anti-collision system connected to the drive control system and configured to detect when movement of the table top along the vertical direction Z is blocked.

Here a blocked movement along the vertical direction Z includes both a full blockage wherein any movement of the table top is prevented as well as a partial block wherein movement of the table top is only slowed down due to an increased resistance experienced by the table top.

Advantageously, the suspension travel reduces or prevents entirely that vibrations generated by the drive unit are passed on to the table top. Resonation of the table top is thereby significantly reduced, which reduces the noise production when adjusting the height of the office furniture. Consequently, the height of the table top may be adjusted at relatively high speeds while only generating moderate noise.

The reduction in vibrations of the table top is further advantageous to the accuracy of the anti-collision system. The reduced vibrations enable the selection of a lower threshold value for the sensor to measure the acceleration and/or deceleration of the table top. Therefore a deceleration of the table top can be measured at an earlier stage, reducing the likelihood that something gets damaged when the table top collides with another object. The anti-collision system thus prevents or reduces the risk that the office furniture or other objects arranged in the vicinity of the office furniture get damaged when vertical movement of the table top is blocked.

In an embodiment, the height-adjustable office furniture further comprises a support frame connected to the bottom surface of the table top, wherein the at least one height adjustable leg unit is connected to the table top through the support frame. The support frame supports the table top. Preferably, the table top is resiliently mounted to the frame to prevent vibration of the table top along with vibrations in the frame. Alternatively, the leg units may be directly connected to the table top. The support frame may include a hollow body, wherein a drive control system and/or components of the anti-collision system may be arranged. The support frame may further serve to house cables, such as for instance power cables that power the drive unit or drive units. In an embodiment, the resilient element is provided between the table top and the support frame.

In an embodiment, a plurality of spacers is placed between the table top and the support frame. The spacers are preferably made of a plastic material or of metal and prevent resonation of the support frame and table top together. The plurality of spacers may be provided as separate elements between the table top and support frame, yet alternatively may also be integrated with the screws used for connecting the table top to the support frame. The guard function of the spacer is then directly provided by the screw. Advantageous to the integration of the spacers with the screws is that the office furniture is easier to assemble.

In an embodiment, the resilient element is a first resilient element and a second resilient element is provided between the drive unit and the support frame.

In an embodiment, the height-adjustable office furniture comprises a guard for receiving the second resilient element with the drive unit connected thereto, the guard preventing compression of the second resilient element during assembly of the office furniture. The guard prevents that the resilient element can get compressed during assembly of the office furniture. The guard thereby ensures that the resilient element can fulfill its function to reduce vibrations being passed on from the drive unit to the support frame.

In an embodiment, the guard is made of a material that is harder than the material of the second resilient element. The resilient element is typically made of rubber. The guard can for instance be made of a metal, metal alloy or a plastic material. The increased hardness of the material of the guard ensures a proper function of the guard, wherein the guard does not compress when the resilient element compresses.

In an embodiment, the drive unit comprises a spindle plate and the second resilient element supports the spindle plate. The second resilient element is supported by the table top or the support frame. All components of the drive unit are connected and/or supported by the spindle plate. As such, vibrations generated by the drive unit when adjusting the height of the office furniture are not passed on to the remainder of the office furniture, reducing vibrations of the table top and/or a support frame.

In an embodiment, the resilient element is ring shaped with a circumferential groove along its outer circumferential surface to support the spindle plate of the drive unit.

In an embodiment, the resilient element and/or the resilient pads are made of rubber. Rubber is ideally suited to provide sound insulation.

In an embodiment, the anti-collision system comprises a sensor connected to the drive control system, wherein the sensor can measure vertical acceleration. The sensor can measure vertical acceleration and identify when the table top gets jammed. Alternatively, a position sensor could be used.

In an embodiment, the sensor is provided at the table top, preferably at the bottom surface of the table top. Here the sensor can be placed out of sight. In embodiments, the support frame may have a partially hollow structure and the sensor and/or the drive control system can be placed in the partially hollow structure.

In an embodiment, the height-adjustable office furniture is configured to adjust the height with an average speed of at least 1 cm/s, preferably at least 3 cm/s, more preferably at least 4 cm/s. Such speeds make the office furniture convenient to use as most height adjustments can be carried out within one minute, preferably in less than half a minute. Typically, more noise is produced when a higher average speed is used, yet due to the travel suspension between the drive unit and the table top a relatively high average speed is possible for only a moderate noise production.

In an embodiment, the noise produced by the height adjustment of the desk is less than 50 dB, preferably less than 45 dB, and more preferably less than 40 dB.

In an embodiment, the table top is made of a light-weight material such as wood. Specifically light-weight materials such a wood have the tendency to resonate strongly when the office furniture is adjusted in height. As such, the invention is particularly suited for table tops made of such light-weight materials. Here a light-weight material is defined as any material having a density of less than 1000 kg/m$^3$.

According to a second aspect of the invention, and in accordance with the effects and advantages as described herein above, there is provided a height adjustable leg unit for the height-adjustable office furniture according to the invention. The height adjustable leg unit is provided with a drive unit that is configured to be only resiliently mounted to the other components of the office furniture.

According to a further aspect of the invention, and in accordance with the effects and advantages as described herein above, there is provided a frame structure for the height-adjustable office furniture according to the invention. The frame structure comprises a support frame configured to support a table top; at least one height adjustable leg unit connected to the support frame, wherein each leg unit is provided with a drive unit to drive adjustment of the height of the leg, wherein a resilient element is provided in the connection between the drive unit and the support frame, the resilient element defining a suspension travel of the table top extending along a vertical direction Z; the frame structure further comprising a drive control system configured to control and power the at least one drive units; and configured to be connected to an anti-collision system. The frame structure is typically configured to receive a table top. In an embodiment, the frame structure is configured to receive a plurality op spacers and/or resilient pads to resiliently mount a table top to the frame structure.

BRIEF DESCRIPTION OF DRAWINGS

Embodiments will now be described, by way of example only, with reference to the accompanying schematic drawings in which corresponding reference symbols indicate corresponding parts. In the drawings, like numerals designate like elements. Multiple instances of an element may each include separate letters appended to the reference number. For example, two instances of a particular element "20" may be labeled as "20*a*" and "20*b*". The reference number may be used without an appended letter (e.g. "20") to generally refer to an unspecified instance or to all instances of that element, while the reference number will include an appended letter (e.g. "20*a*") to refer to a specific instance of the element.

The figures are meant for illustrative purposes only, and do not serve as restriction of the scope or the protection as laid down by the claims.

DESCRIPTION OF EMBODIMENTS

The following is a description of certain embodiments of the invention, given by way of example only and with reference to the figures.

Figure 1A:
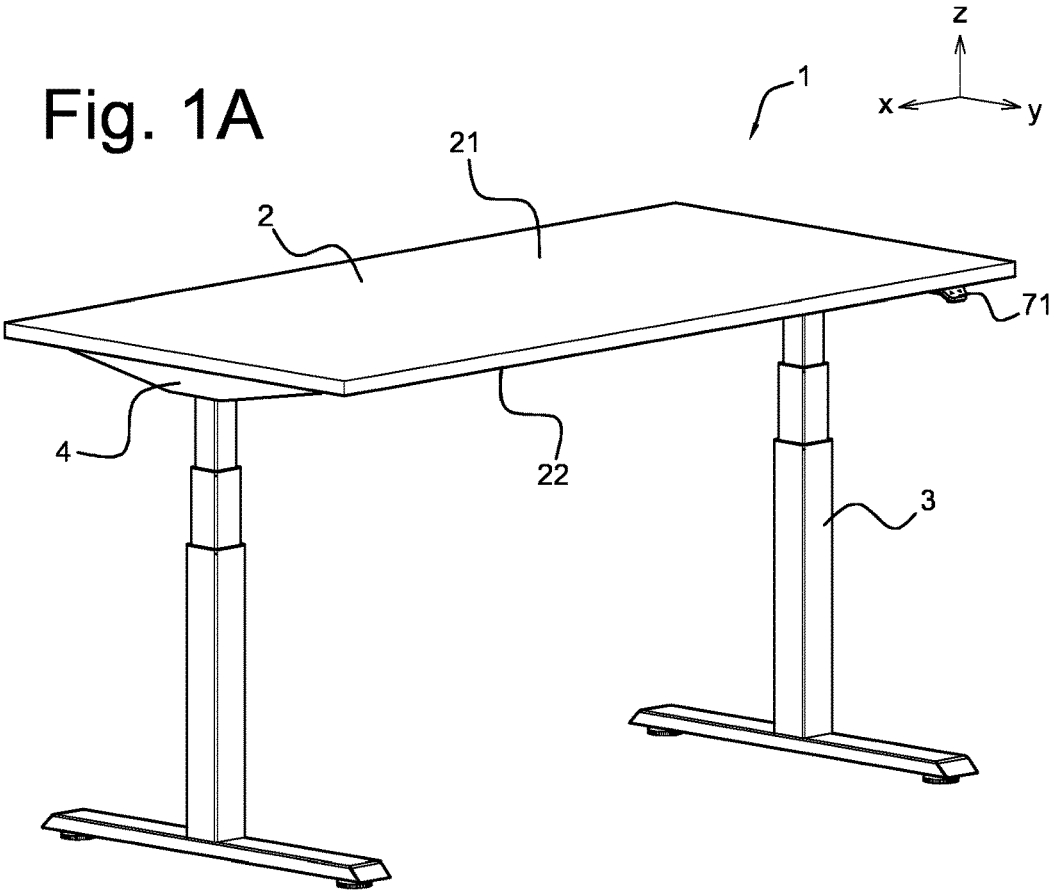
FIG. 1A shows a perspective view of a first embodiment of height-adjustable office furniture.

FIG. 1A shows a perspective view of a first embodiment of a piece of height-adjustable office furniture 1. The piece of height-adjustable office furniture 1 is a desk, which has a table top 2 with a top surface 21 and a bottom surface 22, two height adjustable leg units 3, a support frame 4 and a control panel 71 for adjusting the height of the desk. The top surface 21 of the table top 2 is arranged opposite to the bottom surface 22 and the support frame 4 is engaged to the table top 2 at the bottom surface 22. The height adjustable leg units 3 are connected to each other and the table top 2 through the support frame 4.

Figure 1B:
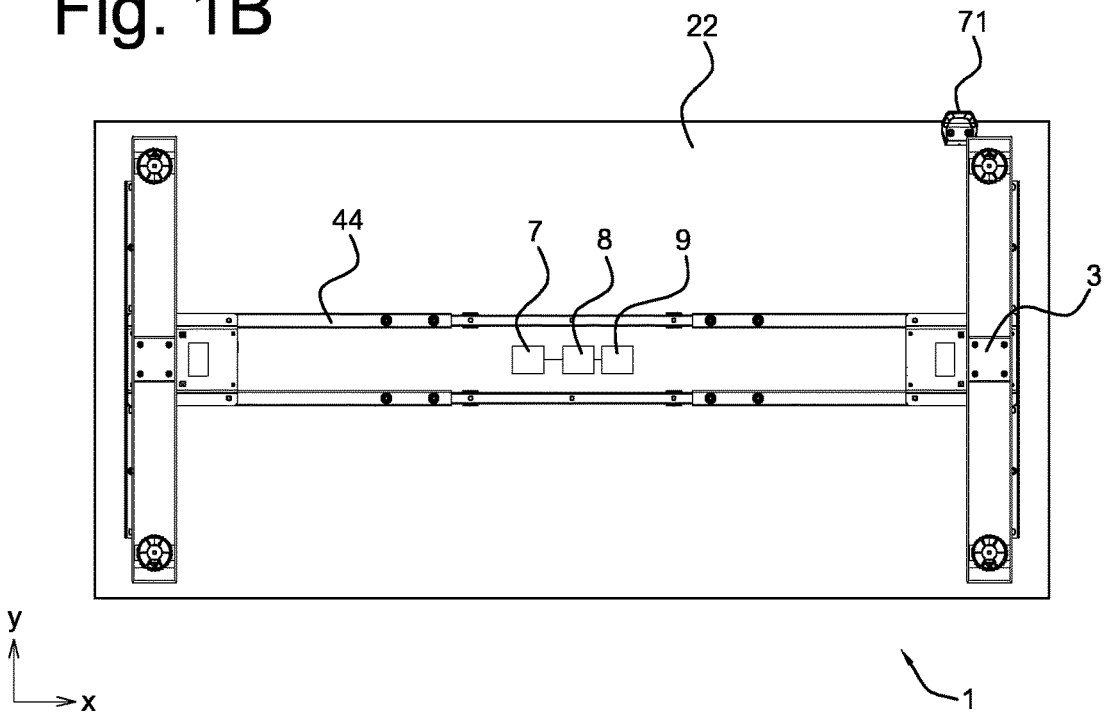
FIG. 1B shows a bottom view of the height-adjustable office furniture in FIG. 1A.

FIG. 1B schematically shows a bottom view of the height adjustable office furniture 1 in FIG. 1A. The office furniture 1 comprises a central drive control system 7 and an anti-collision system 8, which are both indicated only schematically. The drive control system 7 is configured to control a height adjustment of both the leg units 3 the office furniture 1. The drive control system 7 can be connected to a power source (not shown). The anti-collision system 8 includes a sensor 9 (schematically indicated) that can measure vertical acceleration, and which is operatively connected to the drive control system 7 and configured to detect when movement of the table top 2 along the vertical direction Z is slowed down or blocked. The sensor 9 is preferably directly mounted onto the table top where the vibrations are optimally reduced, but it will be understood that alternatively the sensor 9 might also be mounted to the support frame 4. The drive control system 7 is configured to stop height adjustment of the office furniture 1 when the vertical movement to adjust the height is blocked.

The drive control system 7 is operatively connected to the control panel 71 which can be operated by a user to adjust the desk in height. The drive control system 7 can adjust the height of the desk with an average speed of 4 cm/s. During such height adjustment a noise having a strength of maximum 45 dB is created. This combination of relatively high adjustment speed with low volume noise can be created due to a suspension travel of the table top in its connection to the height adjustable leg units 3.

Figure 1C:
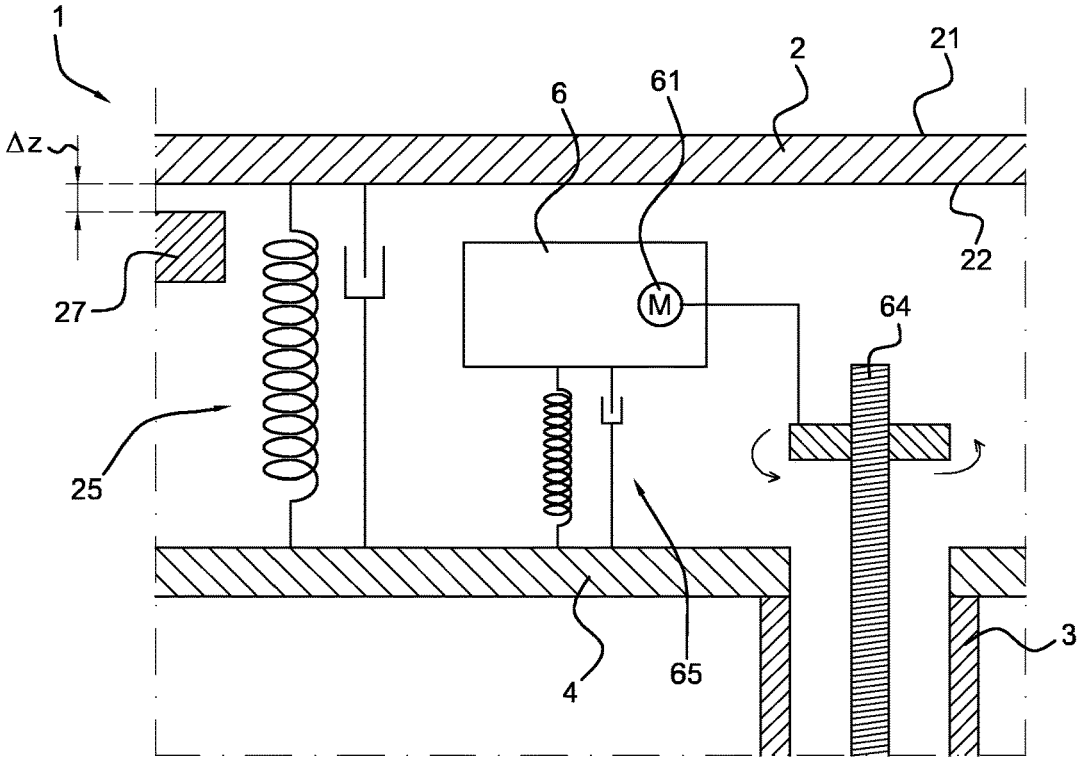
FIG. 1C shows a schematic diagram of the components in the height adjustable office furniture in FIGS. 1A and 1B.

FIG. 1C shows a schematic diagram of the components in the height adjustable office furniture 1. The table top 2 with top surface 21 and bottom surface 22 is indirectly connected to a drive unit 6 via the support frame 4. A first resilient element 25 is provided in the connection between the table top 2 and the support frame 4. Hence the first resilient element 25 is automatically also provided in the connection between the table top 2 and the drive unit 6. The first resilient element 25 is limited by a spacer 27 that ensures a minimum distance between the table top 2 and support frame 4 is always provided. The first resilient element 25 and spacer 27 define a suspension travel Δz of the table top 2 extending along the vertical direction Z.

The drive unit 6 includes a motor 61 and a spindle drive 64. After being connected to a power supply, the motor 61 drives rotation of a spindle drive 64 that extends through the leg unit 3 and actuates a mechanical lift system within the leg unit 3. The drive unit 6 is connected to the frame 4 using a second resilient element 65, limited in its movement by a guard 66.

Figure 1D:
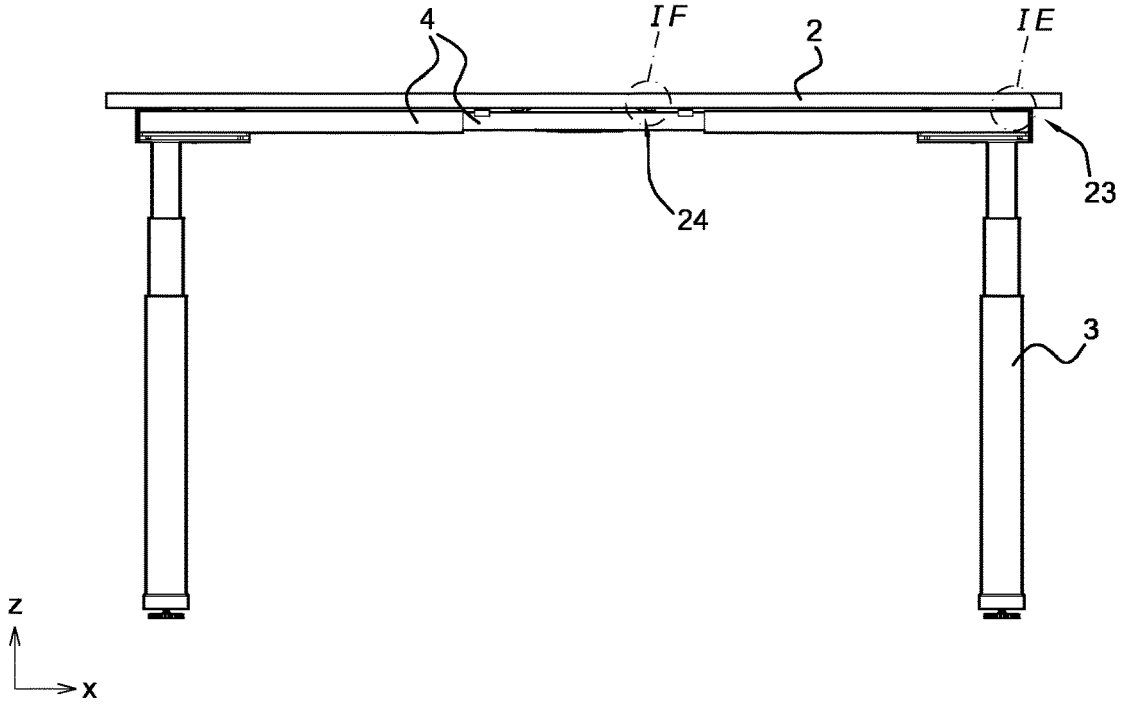
FIG. 1D shows a cross-sectional view of the height-adjustable office furniture in FIGS. 1A and 1B.

FIG. 1D shows a front view of the height-adjustable office furniture 1 according to the invention. The table top 2 is resiliently mounted to the support frame 4. This means that the table top 2 and support frame 4 are not in direct contact with each other over their full length, but only at a limited number of positions. The connection between the table top 2 and support frame 4 is provided by a plurality of corner connections 23 and center connections 24.

Figure 1E:
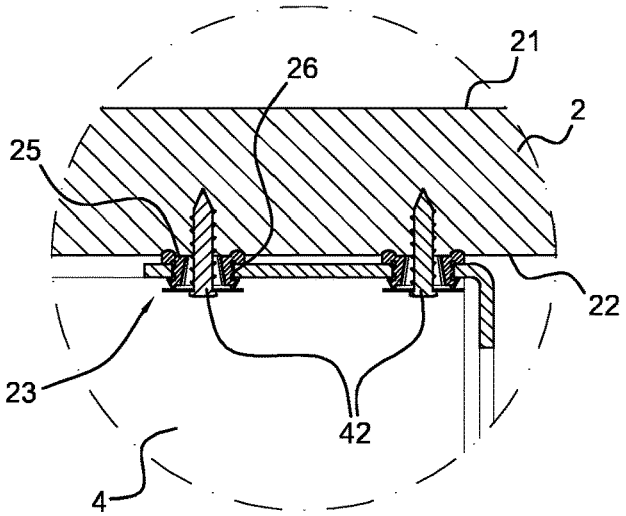
FIGS. 1E and 1F show a cross-sectional view of two details of the height-adjustable office furniture as indicated in FIG. 1D.

FIG. 1E shows a cross-sectional detail of a corner connection 23. Near the edges of the table top 2, the support frame 4 extends substantially parallel to the table top 2. The bottom surface 22 of the table top 2 is connected to the frame using a pair of screws 42. The screws extend through part of the support frame 4 and into the table top 2. Around the screws 42, first resilient elements 25 are provided. The first resilient elements 25 are made of rubber and provide isolation of the table top 2 from the support frame 4. The first resilient element 25 is ring shaped and has a circumferentially extending receptacle 26 for receiving the support frame 4. It will be understood that dependent on the shape of the support frame 4 a varying number of screws 42 may be used.

Figure 1F:
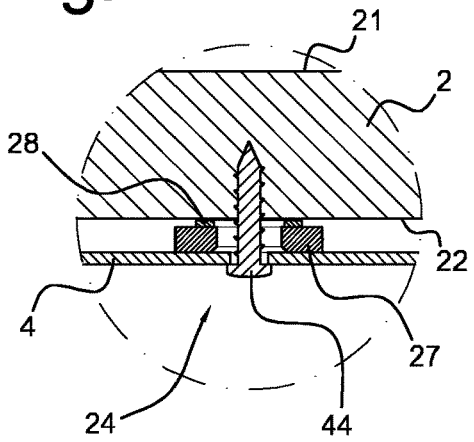

FIG. 1F shows a cross-sectional detail of a center connection 24. The center screw 24 is provided with a spacer 27 that is arranged between the table top 2 and the support frame 4. The spacer 27 is shaped as a ring and is made of a plastic material. A number of center screws 24 are provided between the table top 2 and the support frame 4 to ensure a stable support. It will be understood that dependent on the size of the desk, just a few or more screws 44 and spacers 27 may be provided. Rubber rings 28 are provided between the table top 2 and the support frame 4.

The first resilient elements 25 define the suspension travel Δz extending along the vertical direction Z. The first resilient elements 25, aided by the rubber rings 28, thereby prevent vibrations in the support frame 4 from being passed on to the table top 2. This leads to a reduction of the noise that is generated when the office furniture 1 is adjusted in height. In addition, the reduction in vibrations of the table top 4 increase the accuracy of the sensor 9 in the anti-collision system 8. In comparison to systems without a resilient element, the accuracy of the sensor can be increased by approximately 20%. The corner connections 23 and central connections 24 should be considered in all respects only as illustrative and not restrictive. In embodiments, only one type of connection may be provided with both a resilient element and a spacer integrated in the same connection.

Figure 2A:
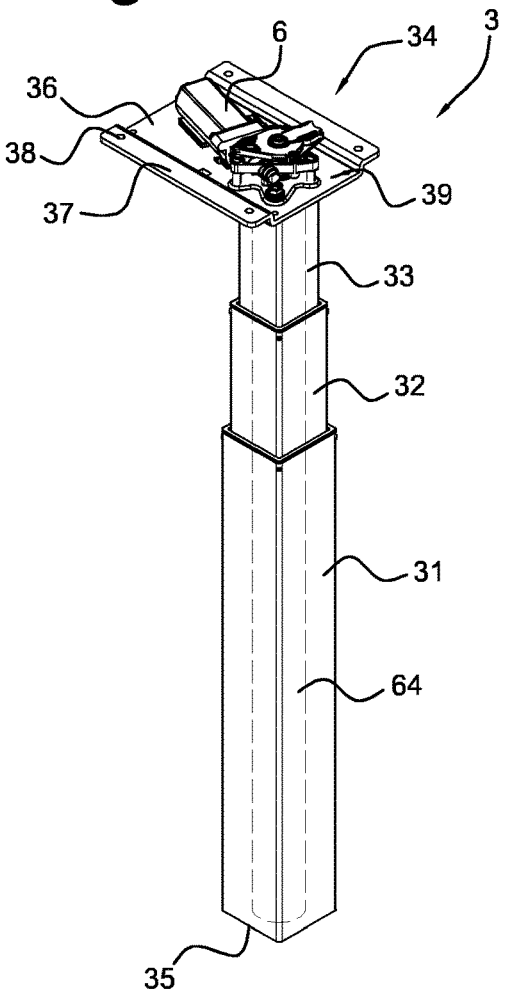
FIG. 2A shows a perspective view of a leg unit of the height-adjustable office furniture in FIG. 1A.

FIG. 2A shows a perspective view of a leg unit 3 of the office furniture 1. The leg unit 3 includes a telescopic type leg having leg segments 31, 32, and 33. The spindle drive 64 is extending through the leg unit 3, which provides the mechanical lift system within the leg unit 3. The leg unit has a top end 34 and a bottom end 35. The top end 34 is provided with a mounting plate 36. The mounting plate has two mounting flanges 37 with openings 38. Bolts may be provided through these openings to connect the leg unit 3 to the support frame 4. It will be understood though that in other embodiments, the leg units 3 may also be directly connected to the table top 2. The mounting plate 36 is further provided with a deepened portion 39 that provides space for a drive unit 6.

Figure 2B:
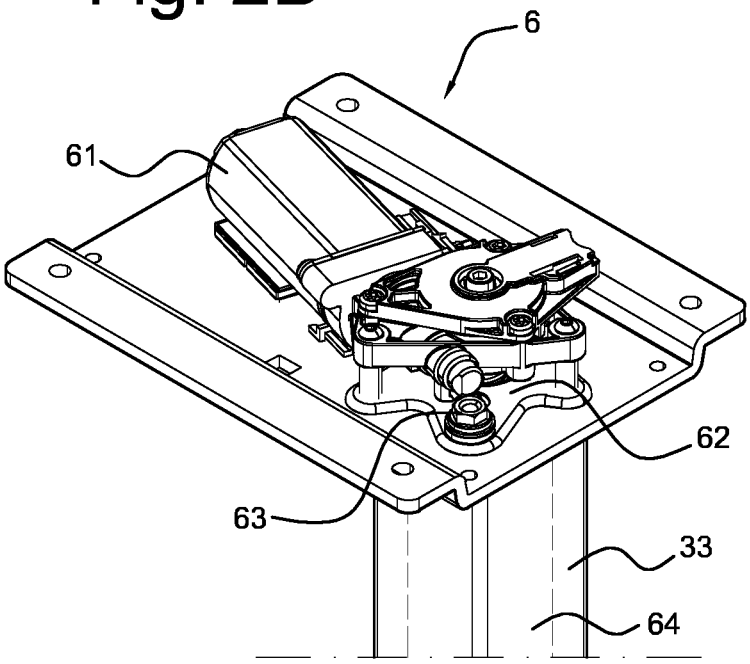
FIG. 2B shows a detail of the leg unit as indicated in FIG. 2A.

FIG. 2B shows a detailed view of the drive unit 6 and mounting plate 36 of the leg unit 3. The drive unit 6 includes a motor 61 a spindle plate 62 and a spindle drive 64. The spindle plate 62 connects to the spindle drive 64 and carries the other elements of the drive unit 6. After being connected to a power supply, the motor 61 drives rotation of a spindle drive 64 that extends through the leg segments 31, 32, 33 and actuates the mechanical lift system within the leg unit 3. The spindle plate 62 is connected to the frame using a plurality of mounting studs 63.

Figure 2C:
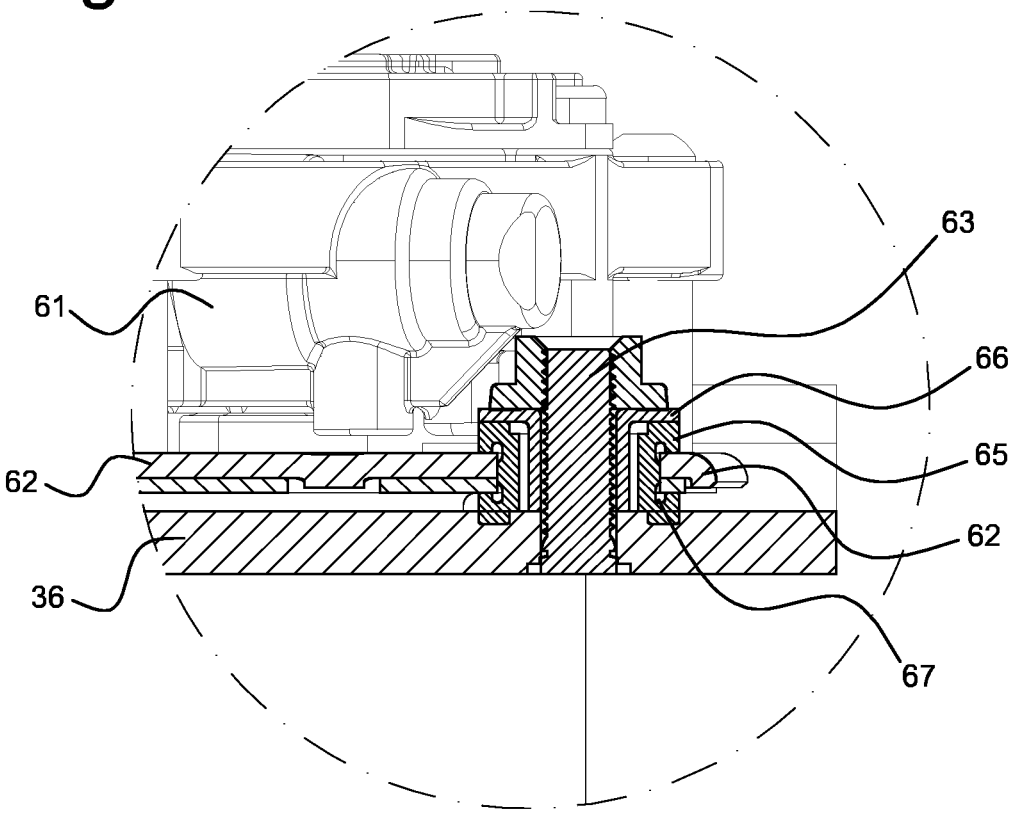
FIG. 2C shows a cross-sectional side view of a mounting stud.

FIG. 2C shows a simplified detail of the connection of the drive unit 6 to the mounting plate 36 through the mounting studs 63. The spindle plate 62 is spaced at a distance of the mounting plate 36 using a second resilient element 65 that supports the spindle plate 62. The second resilient element 65 is a rubber ring with a circumferential groove 67 along its outer circumferential surface. The spindle plate 62 is supported within the circumferential groove 67.

The second resilient element 65 is surrounded by a guard 66 which ensures that the second resilient element 65 is not fastened too tight during assembly in a way that the resilient properties of the second resilient element 65 would not have any effect. The guard 66 is made of steel but also could be made of another metal, metal alloy, or even of a plastic material, as long as the guard 66 has a higher hardness than the rubber of the second resilient element 65.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. It will be apparent to the person skilled in the art that alternative and equivalent embodiments of the invention can be conceived and reduced to practice. All changes which come within the meaning and range of equivalency of the claims are to be embraced within their scope.

The invention claimed is:

1. A height-adjustable office furniture comprising:

a table top having a top surface and a bottom surface opposite to the top surface;

at least one height adjustable leg unit connected to the table top, wherein the at least one leg unit is provided with a drive unit to drive adjustment of the height of the leg, wherein a first resilient element is provided in a connection between the drive unit and the table top, the resilient element defining a suspension travel of the table top extending along a vertical direction Z; the office furniture further comprising a drive control system configured to control and power the drive unit;

a support frame connected to the bottom surface of the table top, wherein the at least one height adjustable leg unit is connected to the table top through the support frame, wherein the first resilient element is provided between the table top and the support frame, and wherein a second resilient element is provided between the drive unit and the support frame, and an anti-collision system connected to the drive control system and configured to detect when movement of the table top along the vertical direction Z is blocked.

2. The height-adjustable office furniture according to claim 1, wherein a plurality of spacers is placed between the table top and the support frame.

3. The height-adjustable office furniture according to claim 2, wherein the spacers are made of a plastic material or metal.

4. The height-adjustable office furniture according to claim 1 comprising a guard for receiving the second resilient element with the drive unit connected thereto, the guard preventing compression of the second resilient element during assembly of the office furniture.

5. The height-adjustable office furniture according to claim 4, wherein the guard is made of a material that is harder than the material of the second resilient element.

6. The height-adjustable office furniture according to claim 1, wherein the drive unit comprises a spindle plate and wherein the second resilient element supports the spindle plate.

7. The height-adjustable office furniture according to claim 6, wherein the second resilient element is ring shaped with a circumferential groove along its outer circumferential surface to support the spindle plate of the drive unit.

8. The height-adjustable office furniture according to claim 1, wherein the first and/or second resilient elements are made of rubber.

9. The height-adjustable office furniture according claim 1, wherein the anti-collision system comprises a sensor connected to the drive control system, wherein the sensor can measure vertical acceleration and/or deceleration.

10. The height-adjustable office furniture according to claim 9, wherein the sensor is provided at the table top.

11. The height-adjustable office furniture according to claim 10, wherein the sensor is provided at the bottom surface of the table top.

12. The height-adjustable office furniture according to claim 1, configured to adjust the height with an average speed of at least 2 cm/s.

13. The height-adjustable office furniture according to claim 1, wherein noise produced by the height adjustment of the desk is less than 50 dB.

14. The height-adjustable office furniture according to claim 1, wherein the table top is made of a light-weight material such as wood.

* * * * *